United States Patent [19]

Koll et al.

[11] 4,077,073

[45] Mar. 7, 1978

[54] SEPARATOR ASSEMBLY FOR TRANSFER MECHANISMS

[75] Inventors: Laurel A. Koll, Ruleville, Miss.; Noel Depew, Wichita, Kans.

[73] Assignee: Mobilizer Medical Products, Inc., Summit, N.J.

[21] Appl. No.: 697,156

[22] Filed: Jun. 17, 1976

[51] Int. Cl.[2] ..... A47B 83/04; A61G 1/02

[52] U.S. Cl. ..... 5/81 R; 5/86

[58] Field of Search ..... 5/81 R, 81 C, 81 B, 5/86; 198/202, 203; 143/35 R; 74/241; 226/21; 250/439, 54–58; 214/83.36

[56] References Cited

U.S. PATENT DOCUMENTS

| | | | |
|---|---|---|---|
| 3,579,672 | 5/1971 | Koll et al. | 5/81 C |
| 3,765,037 | 10/1973 | Dunkin | 5/81 C |
| 3,794,313 | 2/1974 | Berger et al. | 5/81 C |
| 3,854,152 | 12/1974 | Chez | 5/81 C |
| 3,871,036 | 3/1975 | Attenburrow | 5/81 R |
| 3,947,902 | 4/1975 | Conde et al. | 5/81 R |

*Primary Examiner*—Casmir A. Nunberg
*Attorney, Agent, or Firm*—Lane, Aitken, Dunner & Ziems

[57] ABSTRACT

A separator assembly for transfer mechanisms particularly of the type used in the handling and transfer of non-ambulatory hospital patients and including an endless belt trained about a thin, flexible separator plate, a retainer bar adjustably positioned along the rear edge of the separator plate and a drive roller supported by the retainer bar on the edge thereof opposite from the separator plate. An organization of camming bars extend between the retainer bar and the rear edge of the separator plate to adjust the distance between the retainer bar and the separator plate thus to regulate the tension of the belt trained about the drive roller, retainer bar and separator plate. The camming bars may be operated either to adjust the distance between the drive roller and the front edge separator plate in parallel relationship or in canted relationship for belt tracking purposes.

15 Claims, 7 Drawing Figures

SEPARATOR ASSEMBLY FOR TRANSFER MECHANISMS

CROSS-REFERENCE TO RELATED APPLICATION

U.S. application Ser. No. 697,155, filed concurrently herewith by the inventor, Laurel A. Koll.

BACKGROUND OF THE INVENTION

This invention relates to improvements in patient transfer apparatus and more particularly, it concerns an improved upper belt and separator assembly especially suited for use in patient transfer mechanisms of the type disclosed in the aforementioned concurrently filed and co-pending application of Laurel A. Koll.

In U.S. Pat. No. 3,493,979 issued Feb. 10, 1970 to Laurel A. Koll and Walter Crook, Jr., there is disclosed an object transfer method and apparatus by which a pair of superimposed endless belts, trained about plate-like separators or supports, are translated from a retracted position on the deck structure of a litter-like chassis outwardly over a bed or other surface on which an object or patient is initially reclined in a manner such that relative rotation of the endless belts with respect to the separators causes the upper belt flight on the upper separator and the lower belt flight on the lower separator to remain stationary relative to the chassis. These belt flights insulate sliding friction between the separators and the patient, on the one hand, and the separators and the bed or other surface on the other hand as the assembly of the separators and endless belts are translated between the patient and the bed surface until the object or patient overlies the separator. To transfer the patient back onto the litter-like chassis of the transfer apparatus, the lower belt is rotated in a reverse direction relative to its separator while the upper belt is retained against rotation about its support and thus moves as a unit with the upper support to translate the patient in the direction of separator retraction. Hence, both endless belts serve as friction isolating aprons during loading translation of the separator but the upper belt or apron may be conditioned also to transmit frictional forces between the upper support and object or patient when movement of the latter with the support is called for.

Further developments of the basic apparatus disclosed in the aforementioned U.S. patents are found in U.S. Pat. No. 3,579,672 issued May 25, 1971 to Laurel A. Koll and Walter Crook, Jr.; U.S. Pat. No. 3,765,037 issued Oct. 16, 1973 to Albert Dunkin; and more recently, in the aforementioned co-pending application. The disclosure in U.S. Pat. No. 3,579,672 represents a significant improvement over the basic apparatus disclosed in the first-mentioned patent, principally in its recognition that the concept could be applied to very thin, flexible separator plates and by the use of paper-thin teflon-coated fiberglass or nylon belts so that the entire assembly which advanced beneath a patient would be both flexible and extremely thin; that is, on the order of 12 mm. or less. In addition, the belt establishing the upper apron, though endless, was trained through a flight path configuration about the lower separator principally to facilitate more precise control over movement in the flight portions of the endless belt extending about the top, front endge and bottom surfaces of the upper separator. Movement of the lower apron or endless belt, in the disclosure of this patent, is controlled precisely by fixing a portion of the lower flight portion of the lower apron to a front edge of the chassis deck.

In U.S. Pat. No. 3,765,037, the drive organization for the upper belt or apron was improved to provide more positive control over movement of the respective operative belt flight portions and also to facilitate the incorporation of a belt tracking mechanism. In this latter respect, the separators in all of the respective transfer apparatus referred to are on the order of 60 cm. in width and on the order of 180 cm. in length complement the size of a normal patient. The belts forming the aprons being movable transversely or about the narrow dimension of the separators, are thus extremely wide. Although tracking of the lower belt was of no consequence in either of the latter disclosures because it was fixed along its lower flight portion to the chassis deck, the upper belt was much longer than the width of the separators in order to facilitate flight portions cooperating with the drive mechanism. As a result, a tracking mechanism was needed to retain the upper belt centered longitudinally of the separator.

In the aforementioned concurrently filed co-pending application, the upper apron is again formed by a simple endless belt trained about the width of the upper separator and either driven relative to the separator by a drive roller positioned along the rear edge of the separator, or retained against movement relative to the upper separator by non-rotation of the roller. Because of the relatively small diameter of the roller to accommodate the thin plate-like nature of the separator, provision must be made for tensioning the upper belt or apron on the upper separator. In addition, the extreme width of the belt (approximating the length of the separator and thus of a normal person) makes it difficult to assure complete parellelism of the endless belt flights during manufacture. Accordingly, provision must be made for adjusting angular relation of the front edge of the separator with respect to the drive roller so that a given belt will track properly on the separator.

SUMMARY OF THE PRESENT INVENTION

In accordance with the present invention, there is provided an improved separator assembly including novel belt tensioning and tracking arrangement particularly suited for, though not necessarily restricted to use in patient transfer mechanisms of the type referred to. The assembly incorporates, in addition to an improved separator plate, a pair of elongated camming bars disposed for operation between the inner longitudinal edge of the separator plate and a separator retaining bar in turn supporting a drive roller along its outer edge for controlling movement of a thin endless belt supported about the width of the separator plate, the mounting plate and the drive roller. The inner ends of the cam bars overlap each other midway along the length of the retainer bar in mutually engaging camming ramp surfaces operative to increase the effective combined width of the bars at this point upon outward longitudinal movement of the responsive bars. Each of the bars is provided with a second camming ramp surface near the outer end thereof and engageable with a reaction point or pin in the retainer bar. The inclination or throw of each mutually engaging camming ramp is approximately one-half the throw of the second camming ramp in each bar so that equal outward longitudinal movement of both camming bars will result in a combined throw of the mutually engaging ramp surfaces which is the same as the throw of each second camming ramp.

Such equal outward longitudinal movement of the bars will thus result in a parallel separation of the separator plate from the retainer bar to increase tension in the endless belt. However, movement of only one of the camming bars without corresponding movement of the other will result in the same unit of throw at the outer end of the rod so moved, one-half such unit of throw at the inner end of the longitudinally moved camming bar or midway along the length of the separator plate and retainer bar, and zero throw at the outer end of the rod which is unmoved. Such movement of one of the camming bars thus effects a canted separation of the separator plate from the retainer bar to tension only one end of the belt for belt tracking purposes.

The camming bars are connected at their outer ends by adjustable links to a bell crank control arm. The bell crank control arm may be used for release of tension in the endless belt incident to removal thereof, for example, whereas adjustment in the length of the respective links will accommodate the desired belt tension and tracking conformation.

Among the objects of the present invention are therefore: the provision of an unique separator assembly of the type employed in patient transfer mechanism of the type previously referred to; the provision of such an assembly having a novel belt driving, tensioning and tracking mechanism; the provision of such a belt tensioning and tracking mechanism capable of incorporation in an extremely thin belt, separator and drive roller assembly; the provision of an improved belt tracking and tensioning mechanism particularly suited for relatively wide endless belts trained about a support in such a manner that opposed essentially linear flight portions of the belt are spaced extremely closely to one another; the provision of such a belt tracking and tensioning mechanism which is capable of accurate adjustment and yet involves a minimal number of parts; an the provision of such a belt tracking and tensioning assembly formed of easily fabricated components which are readily assembled with respect to each other and with respect to related belt support and driving components.

Other objects and further scope of applicability of the present invention will become apparent from the detailed description to follow taken in conjunction with the accompanying drawings in which like parts are designated by like reference numerals.

DETAILED DESCRIPTION OF THE PREFERRED EMBODIMENT

Figure 1:
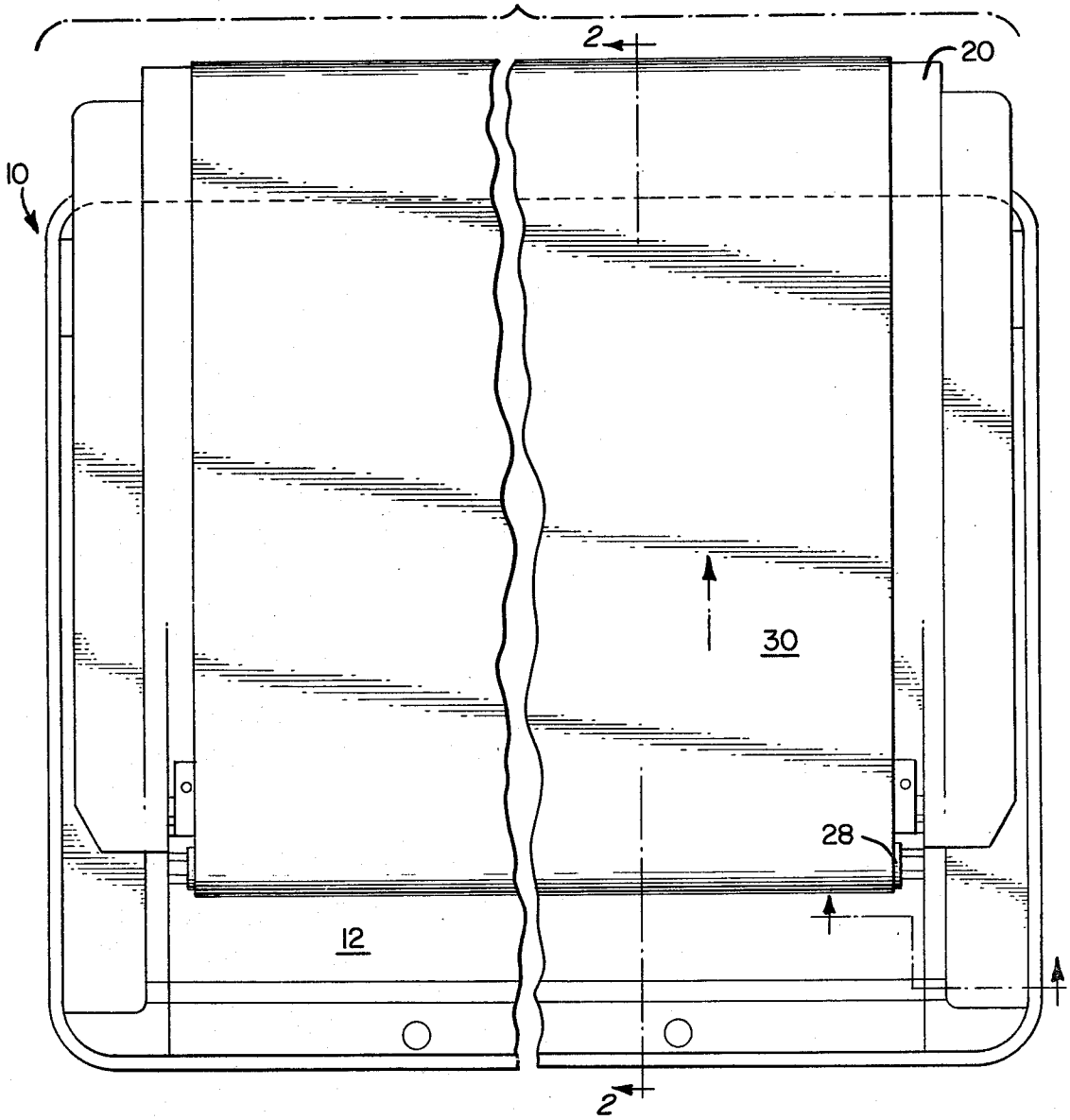
FIG. 1 is a fragmentary plan view illustrating a patient transfer mechanism incorporating the separator assembly of the present invention.
Figure 2:
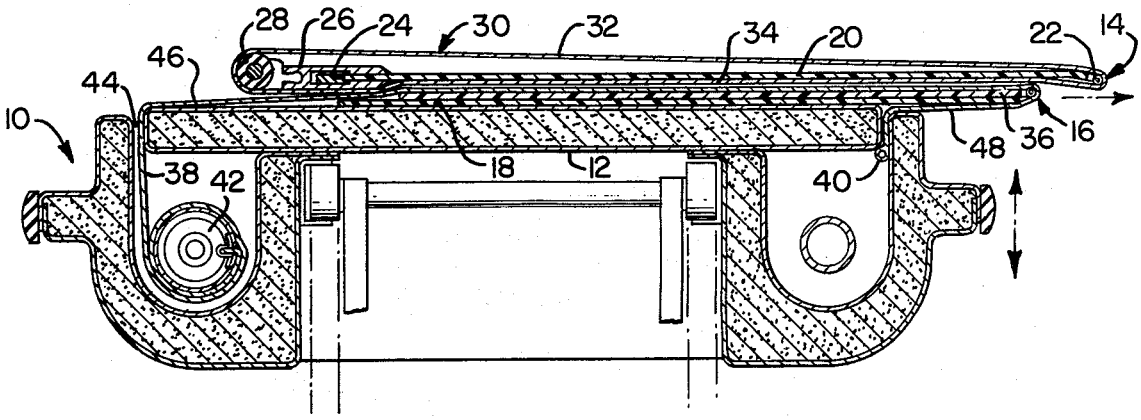
FIG. 2 is a cross-section taken on line 2—2 of FIG. 1.

In FIGS. 1 and 2 of the drawings, the patient transfer mechanism incorporating the present invention is generally designated by the reference numeral 10 and includes as principal load or patient transferring components a deck assembly 12, an upper separator assembly 14, a lower separator assembly 16 underlying the upper separator assembly and a guide plate 18. The upper separator assembly 14 includes an upper separator plate 20 having a front edge 22 and a rear edge 24 joining with a retainer bar 26 supporting a drive roller 28. An upper endless belt 30 is trained about the top and bottom surfaces of the separator plate 20 to establish upper and lower flights 32 and 34, respectively. The lower separator assembly 16 similarly includes a lower separator plate 36, underlying and essentially coextensive with the upper separator plate 20, and a lower apron or double ended belt 38 having one end 40 secured along the front edge of the deck assembly 12 and its other end secured to a winding roller 42 rotatably supported within the deck assembly near the rear edge thereof. As shown, the lower apron 38 extends from the winding roller 42 through a slot 44 along the rear edge of the deck assembly 12 in an upper flight portion 46 over the lower separator 36, about the front edge thereof and through a flight portion 48 to the anchored end 40.

The operation of the transfer components is fully described in the aforementioned co-pending application Ser. No. 697,155 filed concurrently herewith. Accordingly, no further discussion of the transfer mechanism operation is believed necessary except to note that the upper apron or endless belt 30 and the lower apron 38, both of which are formed of an extremely thin teflon-coated conductive nylon fabric, slide relative to each other in various operational modes of the transfer mechanism 10 and to the respective separator plates 20 and 36 about which they are trained. Also, it is important to operation of the mechanism that travel of the upper belt relative to the upper separator 30 be very accurately synchronized with the movement of the other transferring components. Such travelling movement of the endless belt 30 is, moreover, effected solely by transmission of driving friction from the drive roller 28 to the interior low friction surface of the endless belt.

Figure 3:
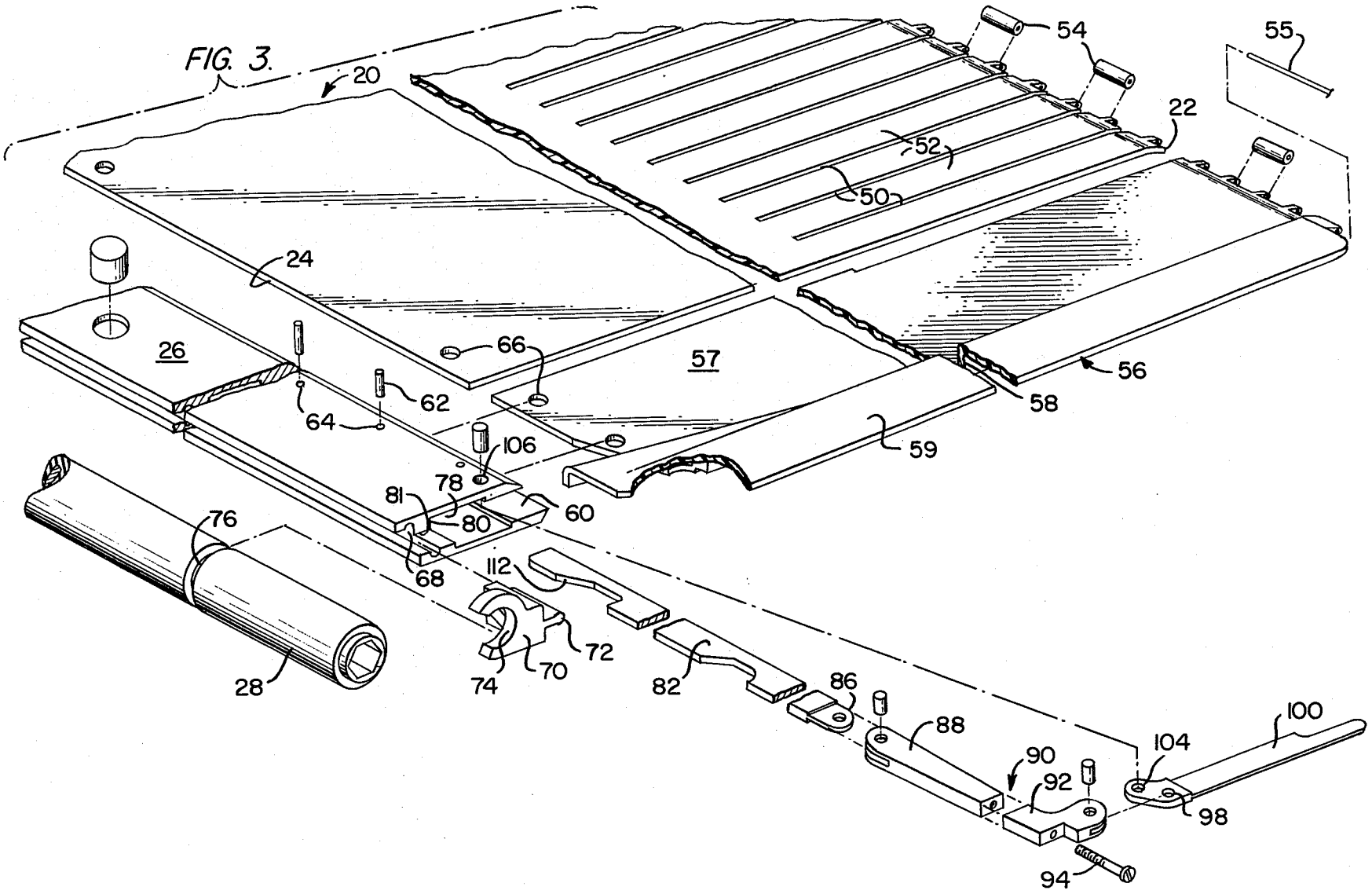
FIG. 3 is an exploded fragmentary perspective view illustrating the components of the separator assembly and belt tensioning and tracking mechanism of the present invention.

As shown most clearly in FIG. 3 of the drawings, the separator plate 20 is a thin flexible plate of suitable material, such as high density polyethylene, on the order of 5 mm. in thickness, 55 cm. in width (the distance between the front and rear edges 22 and 24) and approximately 180 cm. in length. The front portion of the plate 20 is preferably provided with a series of narrow transverse slots 50 extending from the front edge 22 inwardly toward the center of the plate to establish fingers 52 for increased flexibility of the plate over the front portion in which the fingers extend. A plurality of very small guide rollers 54 are journalled for free rotation between the respective fingers 52 along the front edge 22 of the separator plate 20. The rollers 54 are supported on a single longitudinal shaft or wire 55 extending along the front edge 22 throughout the complete length of the separator plate and a pair of end members 56. Although the end members are initially separate from the plate 20, they act as primarily extensions of the separator plate in practice.

Each of the end members 56, as shown, is preferably a molding of suitable material, such as high density polyethylene, and shaped to establish a plate portion 57 contiguous with the plate 20 and joined by a vertical wall portion 58 with an elevated wing or cover portion 59. The cover portion 59 overlies various mechanical components (not shown) of the mechanism 10 so that operation of such components do not interfere with the loading surface defined by the upper separator assembly 14. Also, this construction of the upper separator, in conjunction with a single axis connection of the upper separator assembly 14 to the deck assembly near the rear edge of the separator, permits the assembly to pivot upwardly to provide access for such purposes as cleaning, maintenance and adjustment. The provision of the vertical wall portion 58 and elevated cover portion 59 serves further to stabilize the ends of the separator assembly 16 against excessive bending without sacrifice to flexibility in the plate 20.

The rear edge 24 of the separator plate 20 (and correspondingly of the end members 56) telescope within a forwardly opening slot 60 in the retainer bar 26. This assembly is secured for relative sliding movement of parts by a plurality of relatively small diameter pins 62 extending through relatively small apertures 64 in the retainer bar 26 and through relatively large diameter openings 66 near the rear edge 24 of the separator plate 20.

The retainer bar 26 is provided with an undercut track 68 of continuous cross-section throughout the length of the bar for receiving a series of drive roller clips 70, each having mounting lug portions complementing the cross-sectional shape of the track 68, and partial journals 74 to engage bearing surfaces 76 of reduced diameter along the length of the drive roller 28. The drive roller extends throughout the length of the separator and is of a diameter on the order of 20 mm. The mounting clips 70, therefore, transmit loading on the drive roller to the retainer bar at increments along its length. Although the exterior surface of the drive roller is provided with a rubber-like traction surface, such support by the retainer bar is needed to maintain the overall thinness of the separator assembly 14 while at the same time enabling the endless belt 30 to drawn against the roller 28 under sufficient tension to ensure transmission of torque from the roller to the belt.

The slot 60 in the retainer bar opens inwardly to an internal track 78 having a rearwardly disposed abutment surface 80 established by a web portion 82 extending along the length of the retainer bar 60. A pair of elongated camming bars 82 and 84 are positioned in the track 78 and are operative, in a manner to be described, to adjust the spacing between the abutment surface 80 and the rear edge surface 24 of the separator plate 20.

Each of the camming bars 82 and 84 is pivotally connected at its outer end 86 to one part 88 of an adjustable link 90 having a second L-shaped part 92 secured to the part 88 adjustably by a tension screw 94. The terminal end of the part 92 is connected pivotally by a pin 96 (FIG. 4) extending through an aperture 98 in a bell crank lever 100. The lever 100 is pivotally mounted with respect to the retainer bar 26 by a pin 102 extending through an aperture 104 in the arm 100 and a pair of opposed apertures 106 near the end of the retainer bar 26 in the flanges defining the forwardly opening slot 58 therein. In light of this organization, and as shown most clearly in FIG. 4, movement of the arm 100 between the solid line position shown in FIG. 4 to the phantom line position in this figure will both draw the camming bar 82, 84 to which its associated link 90 is connected, outwardly and also move the pin 96 through an arc beyond a dead-center position on a line extending parallel to the direction of camming bar movement. Further, it will be appreciated that by adjusting the tension screw 94, the relative longitudinal position of each camming bar 82, 84 in the track 78 may be adjusted independently of the aforementioned movement of the arm 100 between the two positions illustrated in FIG. 4.

The inner ends 108 and 110 of the respective camming bars 82 and 84 overlap midway along the length of the retainer bar and thus of the separator plate 20 in formations defining mutually engaging camming ramp surfaces 112 and 114. The surfaces 112 and 114 are inclined at an angle A in a manner such that relative outward movement of the bars 82 and 94 will result in an increase of the combined widths of the camming bars 82 and 84 at their inner ends 108 and 110. A second camming ramp 116 is provided near the outer end of each camming bar and having an inclination represented by the angle B. Each of the second camming ramp surfaces 116 is located adjacent a reaction point established by a pin 118 extending through the retainer bar 26 and centered on the abutment surface 80 in the web portion 81 thereof. The angle B is approximately twice the angle A to provide in the ramp 116 a throw twice the throw for any one of the mutually engaging camming ramp surfaces 112 and 114 for a given longitudinal movement of either of the camming bars 82 or 84.

Figure 4:
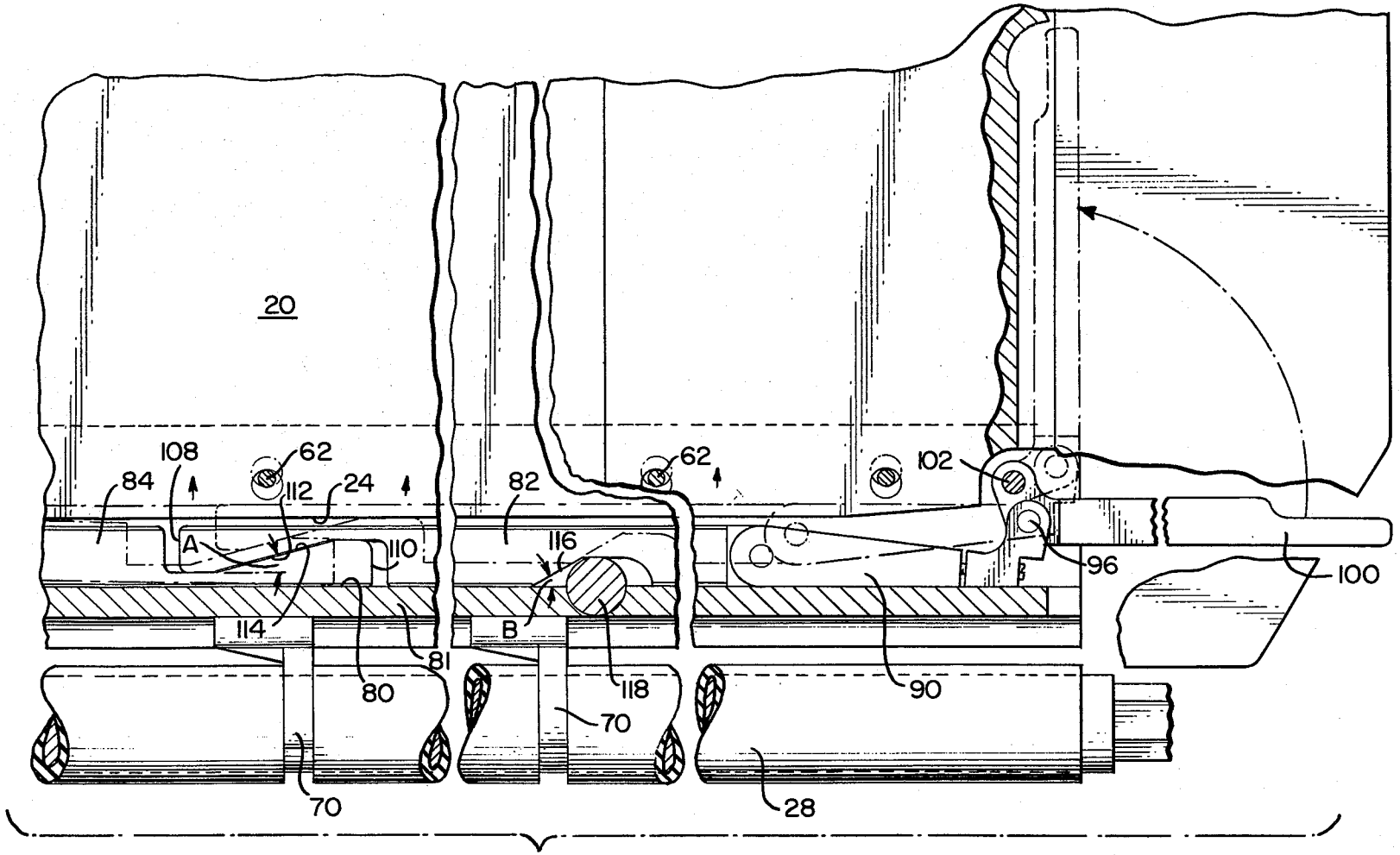
FIG. 4 is an enlarged plan view partially in cross-section illustrating the components shown in FIG. 3 but in an assembled condition.
Figure 5:
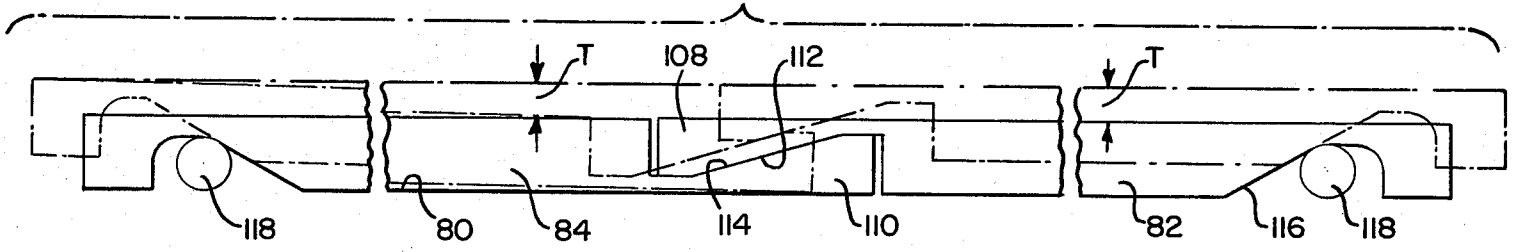
FIGS. 5, 6 and 7 are exaggerated schematic views illustrating the respective extreme camming br positions of the belt tensioning and tracking mechanism.

The manner in which the camming bars 82 and 84 may be adjusted to serve both belt tensioning and belt tracking functions in the separator assembly 14 may be appreciated by reference to FIGS. 4 and FIGS. 5–7 of the drawings. In this respect, it is to be noted that the belt 30 is dimensioned to pass about the assembly of the separator plate 20, retainer bar 26 and drive roller 28 in a slightly slackened condition with the arm 100 positioned in solid lines as shown in FIG. 4. In this condition, the rear edge 24 of the separator plate 200 is spaced from the abutment surface 80 of the retainer bar by the width of one camming bar. If it is assumed that the belt 30 is a perfect cylinder or that the belt 30 will be uniformly tensioned throughout its length upon parallel expansion of the front edge 22 of the separator plate and the drive roller 28, and the combined length of each link 90 and its connected camming rod 82, 84 is equal by a proper adjustment of the tension screws 94, movement of the arms 100 from the solid line position in FIG. 4 to the phantom line position will result in a parallel tensioning movement of the separator plate 20 out of the slot 60. Such parallel outward movement of the respective camming bars 82 and 84 is depicted in FIG. 5 of the drawings. As shown, the outer ends of both bars will be moved away from the abutment surface 80 by the second camming surfaces 116 riding up on the pins 118 through a distance represented by the dimension T in FIG. 5. Also as a result of such longitudinal movement of both bars 82 and 84 equally, the mutually engaging camming surfaces 114 will combine to advance the inner end 108 of the bar 82 outwardly through the same distance. This movement of the inner end of the bar 82 occurs even though the ramps 112 and 114 are inclined at half the angle of the ramps 116 because the combination of ramp angle and reaction point movement in this instance provides a combined throw equal to the dimension T.

Figure 6:
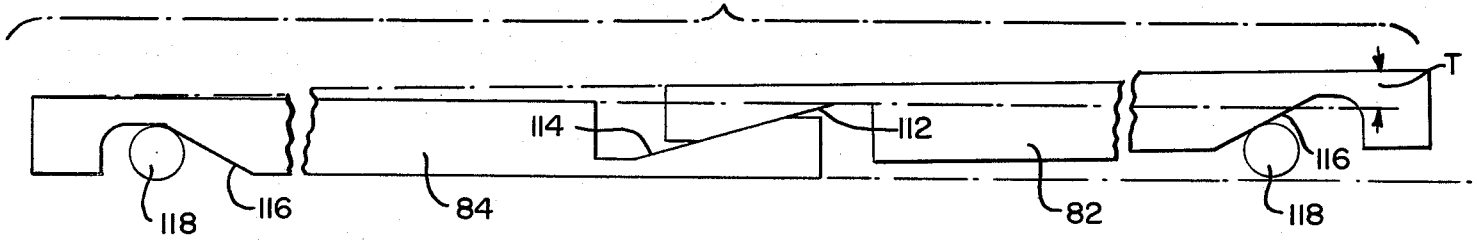
Figure 7:
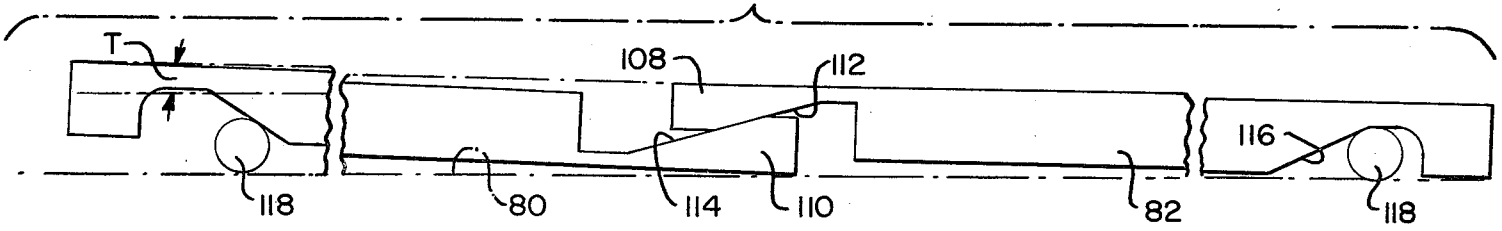

The effect of moving only one of the bars 82 or 84 while the other remains in place is shown in FIGS. 6 and 7 of the drawings respectively. Thus, in FIG. 6, the bar 84 is left in its initial position whereas the bar 82 is moved outwardly as a result of adjusting the tension screw 94 associated with the camming bar 82. As a result, the outer end 86 is moved outwardly through the distance T for a given movement of the ramp 116 in relation to the fixed pin 118 whereas the inner end 108 of the bar 82 will move through only one-half the distance or T/2. The outer end 86 of the bar 84, of course, will not move. As a result, the separator 20 is canted with respect to the drive roller 28 to effect a tracking action on the belt 30. In FIG. 7 of the drawings, the camming bar 82 is retained in a stationary position whereas the bar 84 is moved outwardly to bring about a condition essentially the reverse of that shown in FIG. 6.

Thus it will be seen that by this invention there is provided an improved belt tracking and tensioning mechanism by which the above mentioned objectives are completely fulfilled. In addition, it will be apparent to those skilled in the art that modifications of the disclosed embodiment may be made without departure from the inventive concept manifested thereby. Accordingly, it is expressly intended that the foregoing description be illustrative of a preferred embodiment only, not limiting, and that the true spirit and scope of the present invention be determined by reference to the appended claims.

We claim:

1. A separator assembly for patient transfer mechanisms comprising:

a thin, flexible separator plate having front and rear edges;

a retainer bar having front and rear edges and disposed along the rear edge of said separator plate, said retainer bar having forwardly extending flange portions to define a slot opening in the front edge thereof and to receive the rear edge of said separator plate;

a drive roller located along the rear edge of said retainer bar;

means rotatably supporting said drive roller from the rear edge of said retainer bar at points spaced along the length of said drive roller and of said retainer bar;

an endless belt trained about said drive, roller said retainer bar and the front edge of said separator plate; and means for adjusting the distance between the front edge of said separator and said drive roller thereby to adjust the tension in said endless belt.

2. The apparatus recited in claim 1 including end members supported at opposite ends of said separator plate, each of said end members having a plate portion of same thickness of said separator plate and contiguous therewith, a vertical wall portion joining with the outside of said plate portion and a cover portion extending outwardly from the top of said vertical wall portion.

3. The apparatus recited in claim 2 including a plurality of rollers located along the front edge of said separator plate and of said end member plate portions, and common shaft means for rotatably supporting said rollers, said shaft means extending completely along the front edge of said separator and of said end member plate portions.

4. The apparatus recited in claim 1 wherein said drive roller comprises an alternating series of cylindrical traction surfaces and bearing journals of reduced diameter relative to the diameter of said cylindrical traction surfaces and wherein said means rotatable supporting said drive roller comprises a plurality of retainer clips supported by said retainer bar and operative to transit bending stresses on said roller directly to said retainer bar.

5. The apparatus recited in claim 1 wherein said means for adjusting the distance between the front edge of said separator and said drive roller comprises means defining an abutment surface between said forwardly extending flange portions of said retainer bar, said abutment surface being normally spaced from the rear edge of said separator plate, a pair of elongated camming bars positioned between said abutment surface and the rear edge of said separator plate, said camming bars being of combined length approximating the length of the retainer bar and overlapping at the inner ends thereof in mutually engaging inclined camming ramps, each of said bars having an additional camming ramp near the outer opposite ends thereof, said additional camming ramp having a throw angle approximately two times the throw angle of either of said mutually engaging camming surfaces individually, means defining a fixed reaction point in said abutment surface for engagement by each of said additional camming ramps, and means for independently moving said camming bars longitudinally relative to each other and to said reaction point.

6. The apparatus recited in claim 5 wherein said means for moving said camming bars longitudinally comprises a lever arm pivotally connected to each end of said retainer bar, and link means connecting said lever arm to the outer end of each of said camming bars.

7. The apparatus recited in claim 6 wherein each of said lever arms is pivotal about a first axis and wherein each of said links is connected to said lever arm at a second axis, said second axis being movable about said first axis in an arc extending through a line parallel with the direction of camming bar longitudinal movement whereby said lever arms may pass through a top-dead-center position in pivotal movement about said first axis.

8. The apparatus recited in claim 6 including means to adjust the length of each of said links, said link adjusting means being adjustable for each of said camming bars independently to adjust the angular relationship of the rear edge of said separator plate and said abutment surface.

9. The apparatus recited in claim 6 wherein the thickness of said lever arms is less than the thickness of said separator plate.

10. In a patient transfer mechanism separator assembly including an endless belt trained transversely about a thin, elongated separator plate having front and rear edges, and a drive roller mounted along the rear edge of the plate to develop flight movement of the belt about the drive roller and front edge of the separator plate, belt tensioning and tracking means comprising:

a retainer bar supporting the drive roller along one edge and having flange portions to define a slot opening forwardly through the other edge thereof, said slot receiving the rear edge of the separator plate;

an elongated linear abutment surface between said flanges and spaced rearwardly of the front edge of said bar;

a pair of elongated camming bars located within said retainer bar between said abutment surface and the rear edge of the separator plate, said camming bars being of a combined length approximating the length of the separator plate and overlapping at the inner ends thereof in mutually engaging inclined camming ramps, each of said bars having an additional camming ramp near the outer end thereof, said additional camming ramp having a throw angle approximately two times the throw angle of either of said mutually engaging camming surfaces; and means defining a fixed reaction point for said second camming ramps in said abutment surface whereby equal and opposite movement of said camming bars through a unit of longitudinal distance will advance the rear edge of the separator plate away from said abutment surface in parallel relationship with said abutment surface and whereby movement of either one of said camming bars alone will effect a canted separation of the rear edge of the separator plate and said abutment surface.

11. The apparatus recited in claim 10 including means for independently moving said camming bars longitudinally relative to each other and to said reaction points.

12. The apparatus recited in claim 11 wherein said means for moving said camming bars longitudinally comprises a lever arm pivotally connected to each end of said retainer bar and link means connecting said lever arm to the outer end of each of said camming bars.

13. The apparatus recited in claim 12 wherein each of said lever arms is pivotal about a first axis and wherein each of said links is connected to said respective lever arm at a second axis, said second axis being movable about said first axis in an arc extending through a line parallel with the direction of camming bar movement whereby said lever arms pass through a top-dead-center position in pivotal movement about said first axis.

14. The apparatus recited in claim 11 including means to adjust the length of each of said links, said link adjusting means being adjustable for each of said camming bars independently.

15. A belt tensioning and tracking mechanism for an endless belt trained transversely about an elongated relatively thin supporting plate having a belt driving roller along one edge thereof said mechanism comprising:

means supporting said roller on an axis movable transversely of the plate and relative to the one edge thereof, said means defining an abutment surface fixed with respect to the roller axis and spaced from the one edge of the plate;

a pair of elongated camming bars positioned between said abutment surface and the one edge of the plate, said camming bars being of a combined length approximating the length of the plate and overlapping at the inner ends thereof in mutually engaging inclined camming ramps, each of said bars having an additional camming ramp near the outer opposite ends thereof, said additional camming ramp having a throw angle approximately two times the throw angle of either of said mutually engaging camming surfaces individually;

means defining a fixed reaction point in said abutment surface for engagement by each of said second camming ramps; and means for independently moving said camming bars longitudinally relative to each other and to said reaction point whereby simultaneous longitudinal movement of both camming bars effects parallel separation of the drive roller and the plate and wherein movement of only one of said camming bars while the other remains stationary effects canted separation of the plate and the drive roller for belt tracking purposes.

* * * * *

UNITED STATES PATENT AND TRADEMARK OFFICE

CERTIFICATE OF CORRECTION

PATENT NO. : 4,077,073

DATED : March 7, 1978

INVENTOR(S) : Laurel A. Koll and Noel Depew

It is certified that error appears in the above-identified patent and that said Letters Patent are hereby corrected as shown below:

Column 1, line 66, change "endge" to -- edge --.

Column 2, line 59, change "responsive" to -- respective --.

Column 3, line 37, change "an" to -- and --.

Column 3, line 61, change "br" to -- bar --.

Column 6, line 9, change "94" to -- 84 --.

Column 6, line 32, change "200" to -- 20 --.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*